US006470644B2

(12) United States Patent
James et al.

(10) Patent No.: US 6,470,644 B2
(45) Date of Patent: Oct. 29, 2002

(54) ROOF BRACKET

(75) Inventors: Stephen Mark James, DeSoto, TX (US); Kenneth Herman Beaty, Dallas, TX (US)

(73) Assignee: Varco Pruden Technologies, Inc., Memphis, TN (US)

( * ) Notice: Subject to any disclaimer, the term of this patent is extended or adjusted under 35 U.S.C. 154(b) by 0 days.

(21) Appl. No.: 09/813,694

(22) Filed: Mar. 21, 2001

(65) Prior Publication Data

US 2001/0025458 A1 Oct. 4, 2001

Related U.S. Application Data

(62) Division of application No. 09/174,708, filed on Oct. 19, 1998, now Pat. No. 6,240,682.

(51) Int. Cl.[7] ..... E04G 21/00; E04G 23/00

(52) U.S. Cl. ..... 52/745.06

(58) Field of Search ..... 52/22, 90.2, 93.1, 52/93.2, 263, 745.05, 745.06, 506.01, 506.06, 508

(56) References Cited

U.S. PATENT DOCUMENTS

| | | | |
|---|---|---|---|
| 1,191,283 | A | 7/1916 | Conwell |
| 1,939,732 | A | 12/1933 | Stresau |
| 2,275,037 | A | 3/1942 | Watter |
| 2,286,167 | A | 6/1942 | Davis |
| 2,694,475 | A | 11/1954 | Crafton |
| 2,992,711 | A | 7/1961 | Mitchell et al. |
| 3,038,276 | A | 6/1962 | Butler |
| 3,108,662 | A | 10/1963 | Schick |
| 3,177,620 | A | 4/1965 | Brown et al. |
| 3,177,755 | A | 4/1965 | Kahn |
| 3,217,460 | A | 11/1965 | Downing, Jr. |
| 3,251,167 | A | 5/1966 | Curran |
| 3,392,499 | A | 7/1968 | McManus |
| 3,527,007 | A | 9/1970 | McManus |
| 3,533,204 | A | 10/1970 | Wallace et al. |
| 3,583,121 | A | 6/1971 | Tate et al. |
| 3,604,167 | A | 9/1971 | Hays et al. |
| 3,624,980 | A | 12/1971 | McManus |
| 3,648,426 | A | 3/1972 | Chaudhary |
| 3,720,029 | A | 3/1973 | Curran |
| 3,740,917 | A | 6/1973 | Wong |
| 3,759,006 | A | 9/1973 | Tamboise |
| 3,820,295 | A | 6/1974 | Folley |
| 3,828,514 | A | 8/1974 | Jureit |
| 3,959,942 | A | 6/1976 | Merson |
| 4,099,356 | A | 7/1978 | Graham |
| 4,106,249 | A | 8/1978 | Morton |
| 4,186,535 | A | 2/1980 | Morton |
| 4,189,883 | A | 2/1980 | McManus |
| 4,250,678 | A | 2/1981 | Skuran |

(List continued on next page.)

*Primary Examiner*—Michael Safavi
(74) *Attorney, Agent, or Firm*—Harrison & Egbert

(57) ABSTRACT

Roofing brackets include a first leg that can be attached to vertical members of a roof structure and a second leg that extends at an angle from the first leg and can be attached to horizontal members of the roof structure and/or to a support surface. A first leg of each bracket is formed with a plurality of preformed patterned holes with a second leg of each bracket being formed with a plurality of different sized holes. The second legs of a first set of brackets being attached to a roofing substrate with the first legs of the first set being attached to lower ends of vertical roofing support members. The first legs of a second set of brackets being attached to upper ends of the vertical support members such that the second legs of the second set of brackets have a desired angular orientation angularly offset with respect to the vertical support members. The second legs of the second set of brackets then being attached to a horizontal roofing support member.

7 Claims, 5 Drawing Sheets

U.S. PATENT DOCUMENTS 4,282,619 A 8/1981 Rooney
4,285,173 A 8/1981 Grearson et al.
4,295,310 A 10/1981 McManus
4,329,823 A 5/1982 Simpson
4,333,280 A 6/1982 Morton
4,335,557 A 6/1982 Morton
4,361,993 A 12/1982 Simpson
4,361,998 A 12/1982 Ellison et al.
4,400,922 A 8/1983 Boyer
4,466,224 A 8/1984 Hague
4,494,343 A 1/1985 Berry et al.
4,497,151 A 2/1985 Simpson et al.
4,520,610 A 6/1985 Simpson et al.
4,524,554 A 6/1985 Simpson
4,534,148 A 8/1985 Simpson et al.
4,569,501 A 2/1986 McCracken
4,592,184 A 6/1986 Person et al.
4,597,234 A 7/1986 Simpson
4,608,791 A 9/1986 McClure
4,616,453 A 10/1986 Sheppard, Jr. et al.
4,620,397 A 11/1986 Simpson et al.
4,620,468 A 11/1986 Baumann
4,665,672 A 5/1987 Commins et al.
4,665,677 A 5/1987 Palacio et al.
4,691,491 A * 9/1987 Lilley ..... 52/508
4,745,724 A 5/1988 Reetz
4,894,967 A 1/1990 Morton
5,005,323 A 4/1991 Simpson et al.
5,142,838 A 9/1992 Simpson et al.
5,303,528 A 4/1994 Simpson et al.
5,367,848 A 11/1994 McConnohie
5,412,913 A 5/1995 Daniel et al.
5,511,354 A 4/1996 Eidson
5,577,353 A * 11/1996 Simpson ..... 52/92.2
5,603,187 A 2/1997 Merrin et al.
5,660,004 A 8/1997 Blackmon et al.
5,704,170 A 1/1998 Simpson
5,794,395 A 8/1998 Reed
5,857,292 A 1/1999 Simpson
5,875,592 A * 3/1999 Allman et al. ..... 52/90.2

* cited by examiner

ROOF BRACKET

This is a divisional application of application Ser. No. 09/174,708 filed on Oct. 19,1998, now U.S. Pat. No. 6,240, 682.

FIELD OF THE INVENTION

The present invention is directed to the field of roofing structures and, in particular, to brackets used in roofing structures.

BACKGROUND OF THE INVENTION

Roofing structures in a sloped build-up structural support construction, include a plurality of elongated vertical support posts fastened to roof substrates such as various components combined to comprise the roof composition, which are supported by steel bar joists or other load bearing material. The vertical posts may be fastened directly to the roof substrate or to a base member fastened to the substrate. Fastened to an upper end of the vertical support members are elongated horizontal support members or purlins. Transverse support frames may be constructed at each end of the roof and have brace members extending between the eave line and the ridge at the desired roof grade. The purlins overlap each other longitudinally and extend horizontally along the length of the roof between the brace members of the transverse support frames. The vertical posts are disposed at laps of the purlins and at other intermediate locations. In positions from the eave line toward the ridge, the purlins are disposed at successively higher elevations from the roof substrate.

The construction of roofing structures requires careful planning and attention to specifications. Brackets are used for fastening the vertical posts to the purlins and brackets may be used for fastening the vertical posts to the roof substrate. Workers place brackets in desired positions and drive fasteners through a bracket and into the vertical posts, the purlins, or the roof substrate.

Installers often do not position the screws in the most effective locations on the brackets during installation. Proper screw location on the brackets is important for providing the roofing structure with appropriate strength. Sometimes installers locate the screws too close together, which weakens the structure. In view of the harsh environment of wind, heat and moisture to which roofing structures are exposed, roofing systems that have reduced strength due to ineffective installation, present problems for manufacturers.

SUMMARY OF THE INVENTION

In general, the present invention is directed to roofing brackets or clips used in the fabrication of roofing systems. The roofing bracket includes a plurality of preformed, patterned holes which enable the roofing system to be fabricated effectively and reliably. The brackets are advantageous in that the patterned, preformed holes direct installers to position the fasteners at predetermined locations on the bracket and into the surface to which the bracket is fastened. This provides a reliable, high strength roofing system.

A preferred embodiment of the invention is directed to a roofing structure comprising a plurality of generally vertical members (e.g., posts) fastened to a lower support surface, a plurality of generally horizontal members (e.g., purlins) fastened to the vertical members, and brackets for anchoring the horizontal members to the vertical members. The invention is also directed to the roofing brackets themselves. Each of the brackets comprises a first leg that can be attached to the vertical members and a second leg that extends at an angle from the first leg and can be attached to the horizontal members and/or the support surface. The first leg and the second leg include a plurality of preformed holes having sizes that can receive fasteners. The holes in the first leg are arranged in a pattern of more than one row of holes effective to enable fasteners extending through these holes to be positioned near a generally vertical center line of the vertical members. The roofing system also preferably includes elongated brace members each fastened at a predetermined roof grade to the vertical members at a location below the horizontal support members. Roofing panels are fastened to the horizontal support members.

Referring now to more specific features of the invention, the horizontal members have an upper surface for receiving a roof panel. The pattern in the first leg of the bracket comprises the rows of holes spaced apart from each other by distances sufficient to enable the bracket to be rotated such that the upper surfaces of the horizontal members will be positioned to support the roof panel at a predetermined grade while locating holes of the rows near a generally vertical center line of the vertical members. The pattern preferably comprises two rows, center lines of the holes in each row being aligned with each other.

The holes in the second leg of the bracket may be oriented in a pattern effective for fastening to the support surface. These holes have different sizes for receiving different fasteners. The second leg may further comprise slots. The pattern of holes in the second leg is generally rectangular. Four slots are disposed near each corner of the pattern. First holes are disposed near a long side of the pattern between slots and second holes are disposed near a center of the pattern. The first holes are preferably larger than the second holes. A size of the second holes is effective for receiving self-drilling screws for fastening to steel support members and lag screws for fastening to wood structural members. A size of the first holes is effective for receiving fasteners for fastening to wood and concrete.

The second leg of the bracket may be formed such that a spacing between the slots and a length of the slots are effective to enable fasteners in each of the slots to be fastened near center lines of adjacent bar joist flanges for fastening to different sizes of bar joists. The dimension of the slots in the second leg is preferably about ¼×3/4 inch. The slots are spaced apart from each other by about ⅝ inch in a direction of elongation of the slots.

The roofing system is advantageous in that the plurality of preformed, patterned holes in the brackets enable effective and reliable fabrication. The patterned holes effect this high strength, reliable construction, by controlling the locations of fastener installation. The strength of the roofing system is also increased because the roofing clips can be rotated into a position to achieve a desired roof grade, while permitting holes in the clips to be aligned along a vertical center line of the vertical support members, which is a location of a high strength connection. The roofing clips are also versatile in that they can be used in both the upper and lower locations of the vertical support members, and are engineered to be fastened to most sizes of steel bar joists.

A method of fabricating a roofing structure according to the invention comprises positioning a second leg of a roofing bracket on a lower support surface (e.g., on a surface of a roof substrate). Certain of different sized preformed holes in the second leg are selected to accommodate a fastener that can extend into the support surface. Fasteners are positioned in the selected holes and driven into the support surface. A first leg of the bracket is fastened to a bottom portion of a generally vertical support member. Certain of a plurality of patterned holes in a first leg of another upper bracket are selected to position an upper surface of a generally horizontal member (e.g., purlin) at a desired grade while aligning the selected holes near a vertical center line of the vertical member. Fasteners are positioned in the selected holes of the first leg portion of the upper bracket. In particular, one fastener is positioned in a hole of one of the rows and another fastener is positioned in a hole of the other row, both holes being near the vertical center line of the vertical member. The fasteners are driven into the vertical members. A second leg of the upper bracket is fastened to the horizontal member.

Other embodiments of the invention are contemplated to provide particular features and structural variants of the basic elements. The specific embodiments referred to as well as possible variations, and the various features and advantages of the invention, will become better understood from the accompanying drawings, together in connection with the detailed description that follows.

Figure 1:
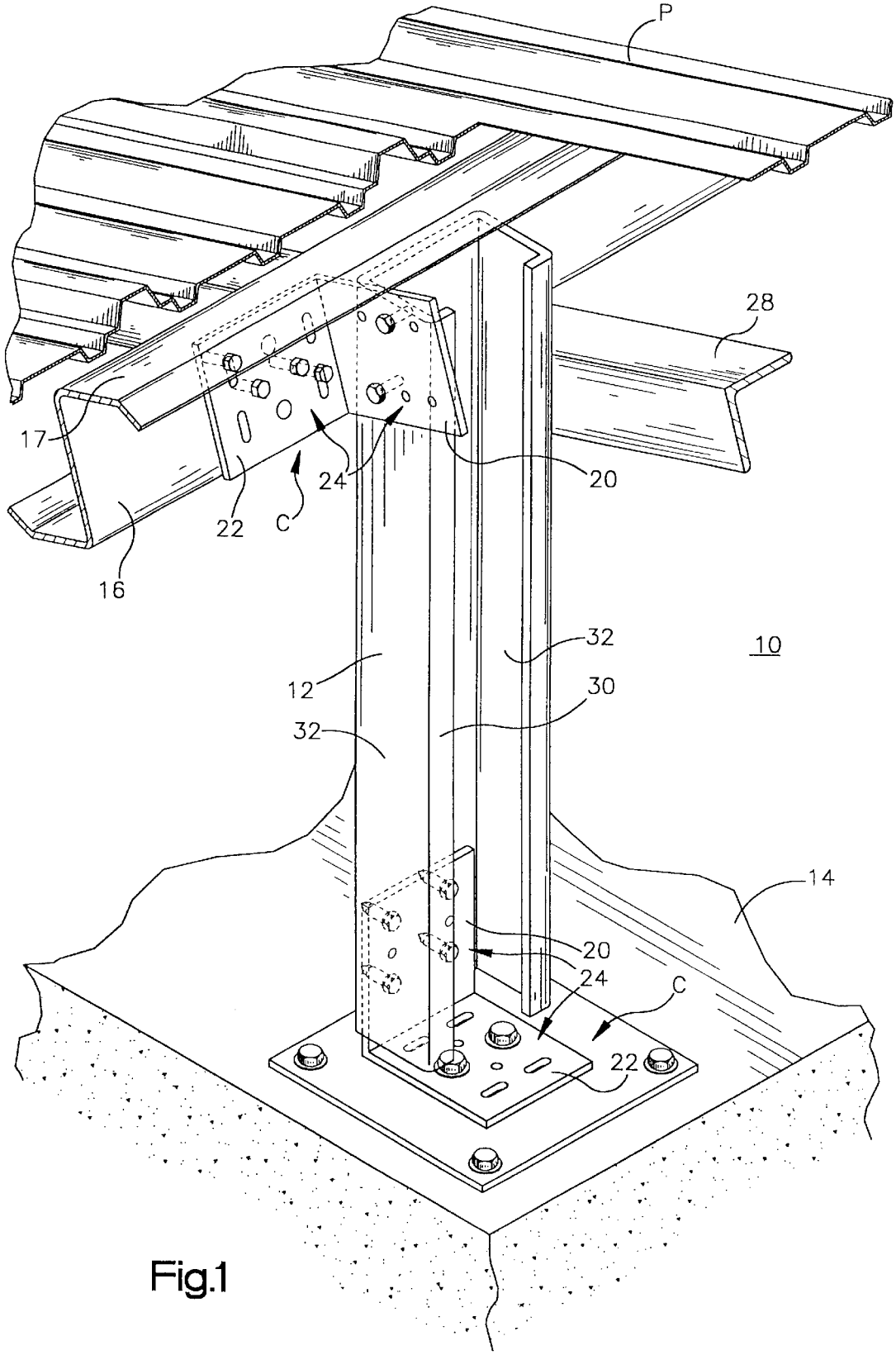
FIG. 1 is a perspective view of a portion of a roofing system constructed in accordance with the present invention.

It will be appreciated that the Figures are not necessarily drawn to scale but are presented for ease of understanding of the invention. The Figures should not be construed as limited the invention to specific dimensions, scales or grades unless otherwise indicated in this disclosure.

DETAILED DESCRIPTION OF PREFERRED EMBODIMENTS

Referring now to the drawings, a portion of a roofing structure is shown generally at 10. A plurality of generally vertical members or posts 12 are fastened to a surface of a roof substrate 14 using roofing brackets or clips C. The same clips C are preferably also used at upper locations of the vertical posts for anchoring a plurality of elongated generally horizontal members or purlins 16 to the vertical posts. Roof panels P are fastened to an upper surface 17 of the purlins. Each of the clips comprises first and second legs 20, 22 extending at an angle from each other, which include a plurality of preformed patterned holes 24 having sizes that can receive fasteners. The clips are preferably used when the grade of the roof is greater than ½:12 inches. A distance dp between a bottom of the post and the support substrate 14 is preferably ⅜ inch, the posts having no vertical adjustability.

Figure 7A:
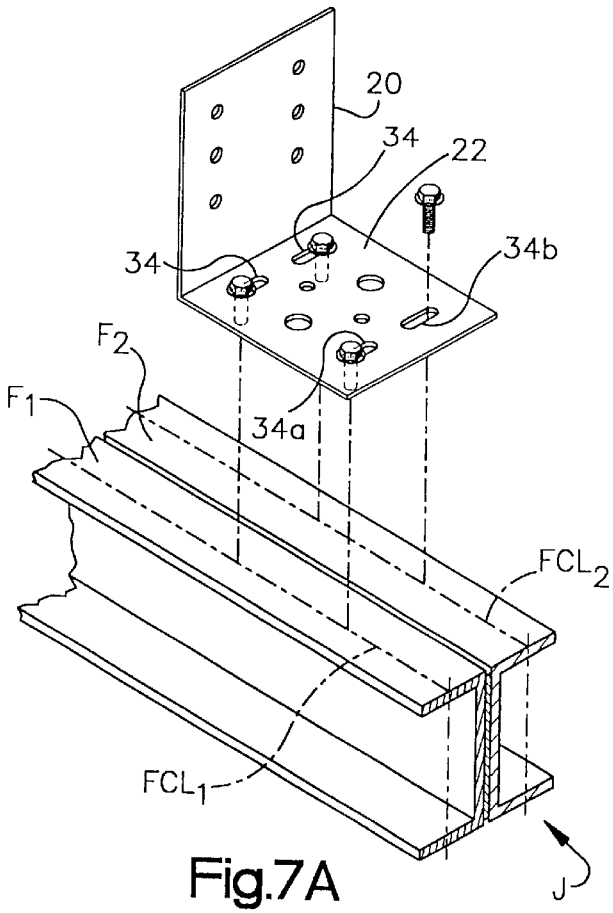
FIG. 7A is a view of the roofing bracket in a position to be fastened to a steel bar joist.
Figure 7B:
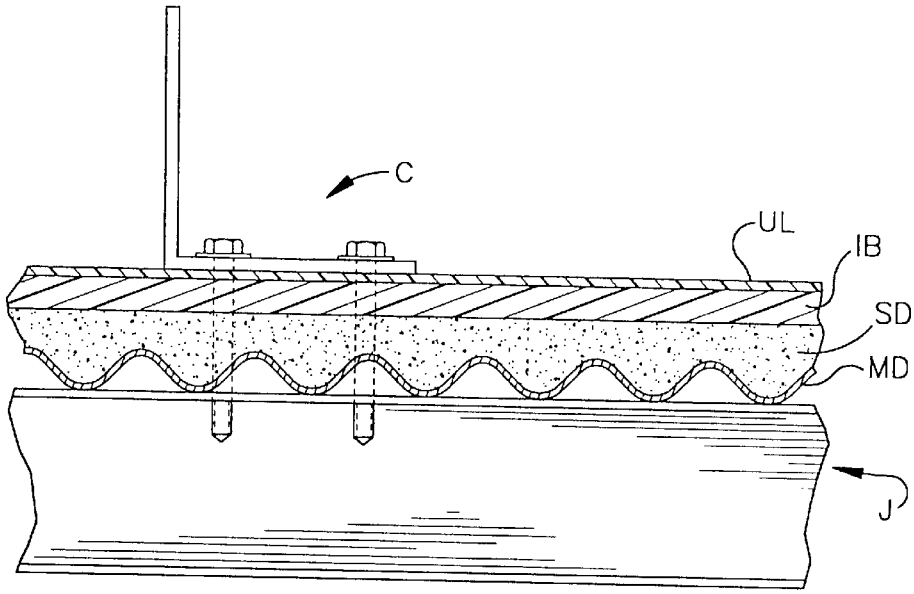
FIG. 7B is a sectional view showing a roofing bracket on a roof substrate.

The roof substrate of FIG. 1 includes concrete or other refractory material. It will be appreciated that the drawings do not show every component that may be used in the roof substrate, or all variants of roof substrates, for the sake of clarity. One example of a roof substrate disposed on a steel bar joist, is shown in FIG. 7B. The roof substrate includes a corrugated metal roof deck MD, a subdeck SD of lightweight gypsum, roofing insulation board IB, and an upper layer UL of tar or gravel.

The roofing structures may be retrofitted onto an existing roof substrate or fabricated onto a new roof substrate. The terms roof substrate as used herein, mean the entire roof composition including roof membrane, insulation and decking. Existing and new roof substrates include, among others, structural concrete decking, metal decking and structural wood decking. Secondary structural support members which underlie the roof substrate, include steel bar or wood joists, girders, or beams. The vertical posts may be fastened directly to the roof substrate or to a base member (not shown) fastened to the roof substrate.

Transverse support frames 26 (FIGS. 9 and 10) may be constructed at each end of the roof having angle brace members 28 extending between the eave line E and the ridge R at the desired grade G of the new roof. Each of the angle braces 28 is disposed at a position beneath the intended placement of the purlins. The purlins extend generally horizontally between the transverse support frames. The purlins may overlap each other in the longitudinal direction, as shown, for example, at locations L (FIG. 10), in the case of the sloped build-up structural support construction. The vertical posts are disposed at laps L of the purlins and at other intermediate locations of the purlins. At positions from the eave line toward the ridge, purlins are disposed at successively higher elevations from the support surface (FIG. 11).

The purlins 16 are preferably generally "Z" shaped in cross section. The vertical posts 12 are preferably generally "C" shaped in cross section. Each vertical post has a central web portion 30 and flange portions 32 each extending from a side edge of the web. The roof panels that may be used may have various configurations such as the PBE panel P shown in FIG. 1 (e.g., 26 and 24 gauge Galvalume steel), the Span-Rib (e.g., 24 and 22 gauge Galvalume steel), the Span-Lock (e.g., 24 and 22 gauge Galvalume steel) and the Snap Seam (e.g., 24 and 22 gauge Galvalume steel), by AEP-Span Retrofit Systems. The angle braces 28 may be formed of 16 gauge (0.0566 inch thick) steel. The brackets C may be formed of 12 gauge (0.105 inch thick) steel as per ASTM A568 G90. The vertical posts and the purlins may be formed from ASTM A568 steel, which is typically 16 gauge (0.065 inch thick) in the case of $^{6}$ ½ and $^{8}$ ½ structural members by VP Buildings.

Figure 2:
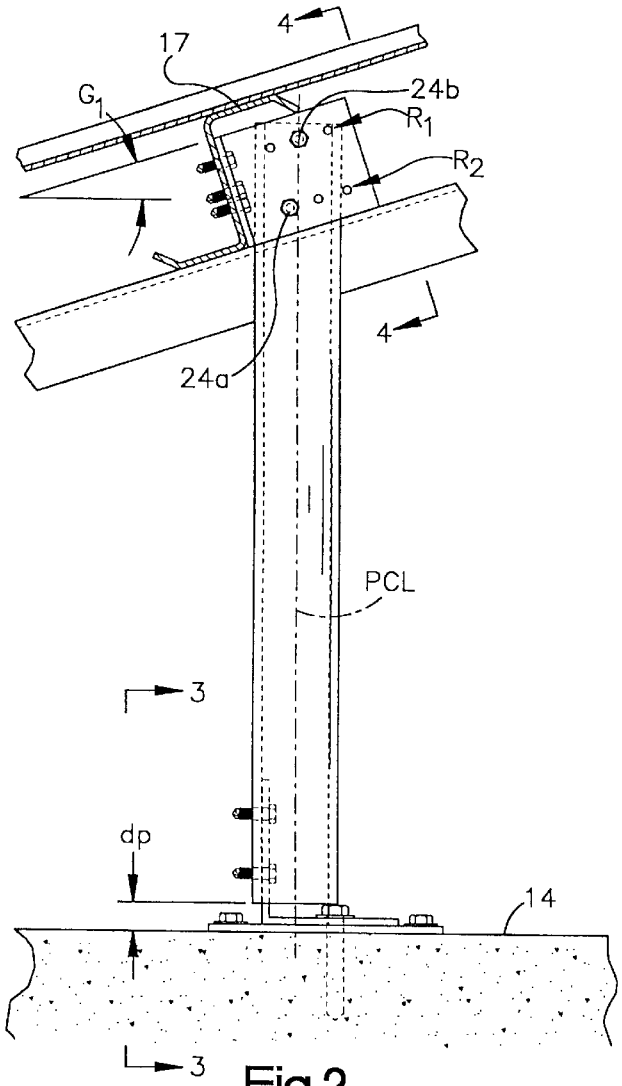
FIG. 2 is an elevational view of the portion of the roofing system shown in FIG. 1.
Figure 3:
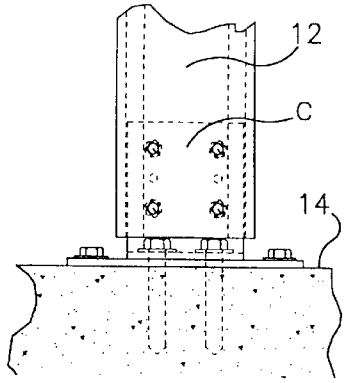
FIG. 3 is a view as seen along the direction represented by lines 3—3 in FIG. 2.
Figure 4:
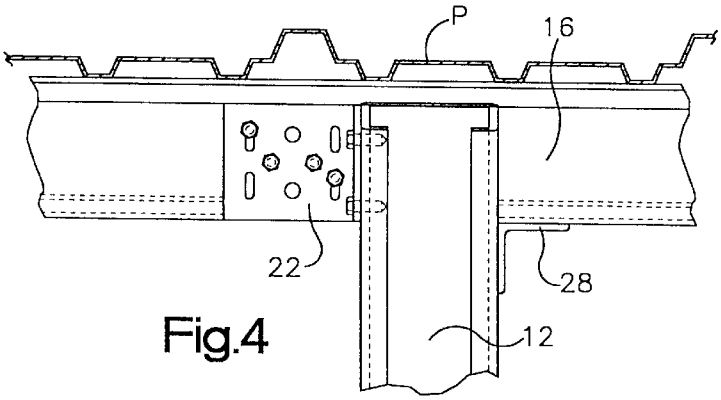
FIG. 4 is a view as seen along the plane and in the direction represented by lines 4—4 in FIG. 2.
Figure 6:
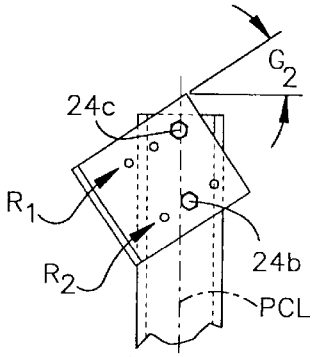
FIG. 6 is an elevational view showing a steep orientation of a roofing bracket in accordance with the present invention.
Figure 5:
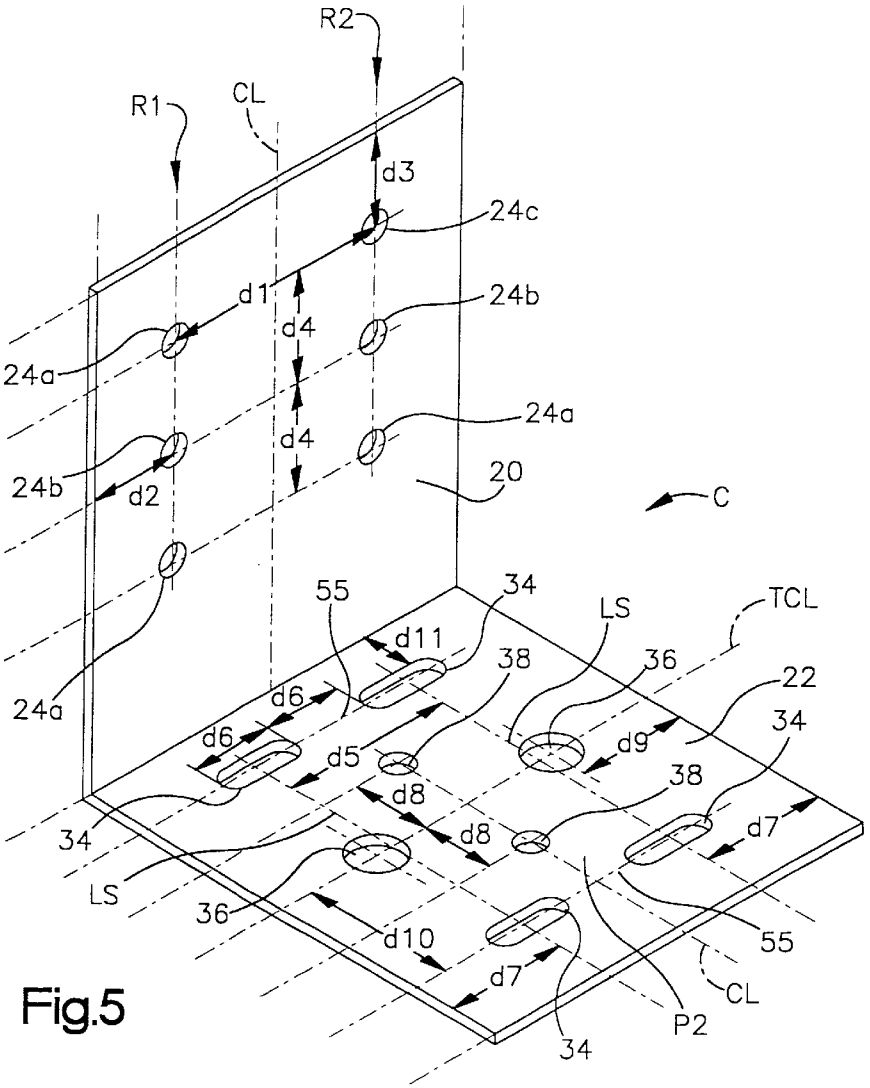
FIG. 5 is a perspective view of a roofing bracket constructed in accordance with the present invention.

As shown in FIG. 5, the pattern in the first leg 20 comprises two rows $R_1$, $R_2$ of three holes 24*a*, 24*b*, 24*c*, the holes in each row being aligned with the other holes of the row. Each hole 24 in the first leg is preferably ¼ inch in diameter. The rows $R_1$, $R_2$ are parallel to the clip center line CL. The holes in each row are oriented and spaced apart from each other effective to enable the clip to be rotated on the vertical post (as best shown in. FIGS. 2 and 6), such that the upper surfaces 17 of the purlins will be positioned to support the roof panel at a predetermined grade while locating a hole of each row near a generally vertical center line (PCL) of the vertical post. Different holes in each row may be selected to effect alignment of the fasteners near the vertical center line of the posts while positioning the upper surface of the purlin at the desired roof grade. For example, referring to FIG. 2, end hole 24*a* in row $R_2$ and center hole 24*b* in row $R_1$ may be selected to provide one roof grade $G_1$, while as shown in FIG. 6 hole 24*b* in row $R_2$ and end hole 24*c* in row $R_1$ may be selected to provide a steeper roof grade $G_2$. In both cases shown in FIGS. 2 and 6, even though the roof grades are different, due to the spacing and arrangement of holes in the first leg, the fasteners are aligned near the vertical center line of the posts PCL.

The following dimensions described herein are exemplary. Other suitable dimensions would be apparent to one skilled in the art in view of this disclosure. Referring to FIG. 5, the dimensions of each leg of the clip are preferably 3 3/8 inch×4 inch. In the first leg 20 the holes in each row are preferably equidistant from the clip center line CL. A distance d1 between center lines of each row of holes, which are parallel to the clip center line, is preferably 1 7/8 inch. A distance d2 between the center line of each hole, which is parallel to the clip center line, and an edge of the first leg, is preferably 3/4 inch. A distance d3 between a transverse center line of end holes 24*c*, which is perpendicular to the clip center line, and an edge of the first leg, is preferably 3/4 inch. A distance d4 between a transverse center line of the end holes 24*c* and a transverse center line of middle holes 24*b*, and a distance d4 between a transverse center line of the middle holes 24*b* and a transverse center line of the end holes 24*a*, is preferably 7/8 inch. The holes 24 in the first leg are preferably aligned with respect to the corresponding hole in the other row (i.e., 24*c* in $R_1$ is aligned with 24*c* in $R_2$) in a direction transverse to the clip center line.

The holes in the second leg 22 are oriented in a pattern for fastening to the support surface and to the purlins. The holes in the second leg have different sizes for receiving different fasteners. The terms "different fasteners" used herein means different sizes of the same fasteners or different types of fasteners. The pattern $P_2$ of holes in the second leg is generally rectangular having two long sides LS and two short sides SS. Four slots 34 are disposed near each corner of the rectangular pattern $P_2$. First holes 36 are disposed near the long sides of the pattern $P_2$ between the slots, and second holes 38 are disposed in a center of the pattern on the clip center line CL. The first holes 36 preferably have a larger diameter than the second holes 38.

A distance d5 is the spacing between the center lines of the slots. As seen in FIGS. 5 and 7A, a spacing ds between the slots in the transverse direction, and a length d6 of each of the slots, are predetermined to enable fasteners in each of the slots to be fastened near center lines of respective bar joist flanges (center lines $FCL_1$ and $FCL_2$) for fastening to most sizes of bar joists J. That is, the slot sizes and positions enable fastening to steel bar joists for most distances between flanges F of their top angle chord members. A fastener in one of the slots (e.g., 34*a*) would be positioned near the center line ($FCL_1$) of one of the flanges $F_1$ of a bar joist's top angle chord members, while a fastener in the other slot of the pair (e.g., 34*b*) would be positioned near the center line ($FCL_2$) of the other of the flanges $F_2$ of the chord members. The dimensions of the slots are preferably 1/4×3/4 inch, wherein d6 is the slot length. The distance d5 is preferably 1 3/8 inch. The spacing ds between slots is preferably 5/8 inch.

A distance d7 between the center line of each slot, which is parallel to the clip center line, and an outer edge of the second leg, is preferably 1 inch. The first holes 36 are preferably 7/16 inch in diameter and the second holes 38 are preferably 1/4 inch in diameter. The second holes 38 are aligned along the clip center line. The center of each of the second holes 38 is spaced a distance d8 of 5/8 inch from a transverse center line TCL. A center of each of the first holes 36 is disposed on the transverse center line. A distance d9 between a center line of the first holes 36 parallel to the clip center line, and an edge of the clip, is 7/8 inch. A distance d10 between the transverse center line TCL and a transverse center line of, each slot, is preferably 1 1/4 inch. The first leg is bent so as to extend at approximately 90 degrees from the second leg, thereby forming a crease. A distance d11 between the crease and the center lines of the innermost slots parallel to the transverse center line TCL, is preferably 3/4 inch.

The same clip C may be used in both the upper and lower locations of the support posts. The first leg 20 can be fastened to the flange 32 or web 30 at the upper location of the vertical posts, as well as to the web 30 at the lower location of the vertical posts. The second leg 22 can be fastened to the purlins 16 at the upper location and to the roof substrate 14 at the lower location.

The quantity of self-drilling screws (sds's) to use in each leg is design dependent. Two, four or six sds's are used in the first leg 20 to secure the clip to the flange at the upper location of the vertical posts. The sds's are 1/4 inch in diameter, have 14 threads per inch and are 7/8 inch long. After the clip has been secured to the vertical post, the second holes 38 in the second leg 22 are used to secure the purlin to the clip. These two holes will be used in all conditions to prevent vertical slippage. In the upper position, the sds's may also be used in the slots (FIG. 1), as determined by design wind and gravity loads. The two first holes 36 need not be used at the upper locations for purlin connection.

When attaching the clips at the bottom location of the vertical posts, the first leg 20 is attached to the web 30 of the vertical post using two, four or six sds's, as determined by design. The second leg 22 is attached to existing or new roof substrates. The purpose of the second holes 38 is to receive 1/4 inch diameter special sds's for attachment to steel support members or for receiving lag screws for attaching to wood structural members. For example, the special sds's are 1/4 inch in diameter by 5 or 8 inches long with 14 or 20 threads per inch. The slots 34 serve the same function as the second holes 38, but the spacing between the slots as well as the slot lengths, are determined to allow for variable hole gauge dimensions (center to center of holes) in steel bar joists. To this end, two or four special sds's would attach to the center points of the two flanges of the bar joist's top angle chord members. The slots enable attachment to the majority of and most commonly used sizes of bar joist top angle chord members. The larger first holes 36 are for structural attachment to concrete and for wood deck attachment. These holes accommodate 3/8 inch diameter concrete anchors such as "Hilti" expansion type, chemical type and others. These large diameter holes also can accommodate 3/8 inch diameter lag screws for attaching to structural wood joists or beams.

In general, a method of fabricating a roof structure according to the present invention comprises positioning the second leg 22 of a roofing clip on the surface of the roof substrate 14 or on spreader plates 40 positioned on the surface of the roof substrate 14, if desired. Certain of the different sized preformed patterned holes in the second leg are selected to accommodate a particular type and size of fastener. The fasteners are positioned in the selected holes and driven into the support surface. For example, concrete fasteners are received by the first holes 36 for fastening to the concrete substrate shown in FIG. 1. The first leg 20 of the clip is fastened to the web 30 at the bottom of the post. For example, four sds's are positioned as shown in FIG. 1.

Certain of the plurality of patterned holes in a first leg 20 of another upper clip are selected to enable positioning of the upper surface 17 of the purlin 16 at a desired grade while aligning the selected holes near the vertical center line (PCL) of the post. Fasteners (e.g., two sds's as shown in FIG. 1) are positioned in the selected holes of the first leg of that clip and drilled into the vertical posts. Into the second holes of the second leg of the upper bracket are positioned two fasteners (e.g., four sds's in the positions shown in FIG. 1) which are drilled into the purlin, using the angle braces 28 as a template for setting the grade of the purling.

Figure 8:
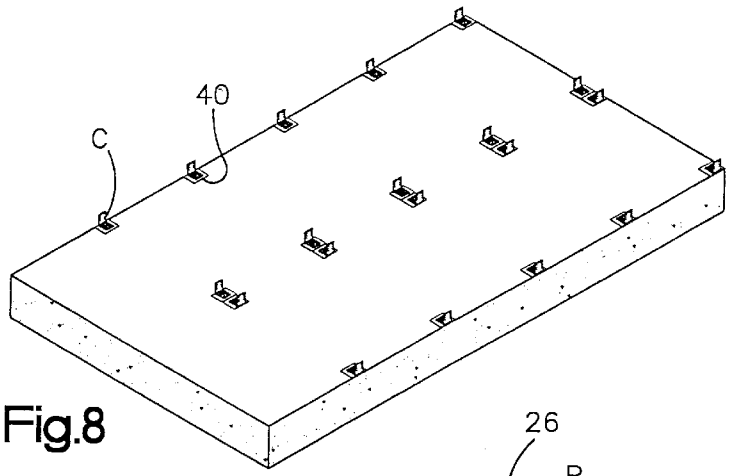
FIGS. 8–12 show the sequential construction of a roofing system in accordance with the present invention.
Figure 9:
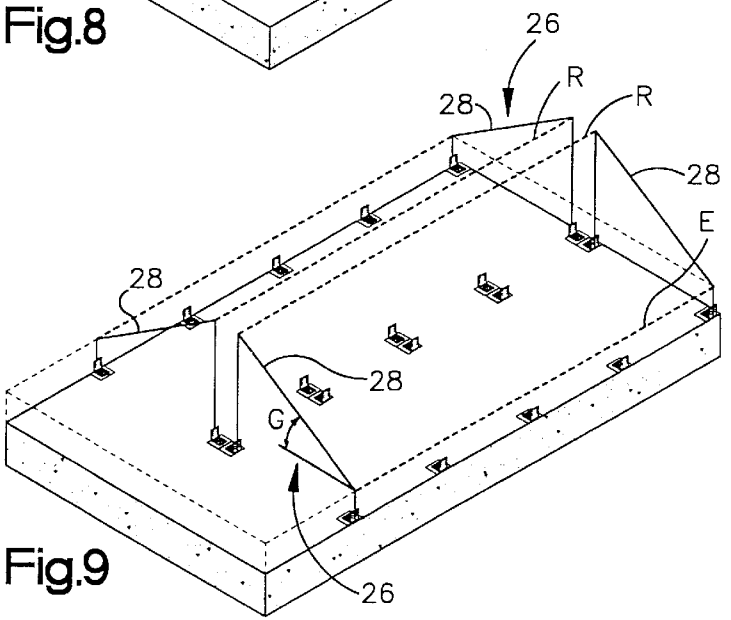
Figure 10:
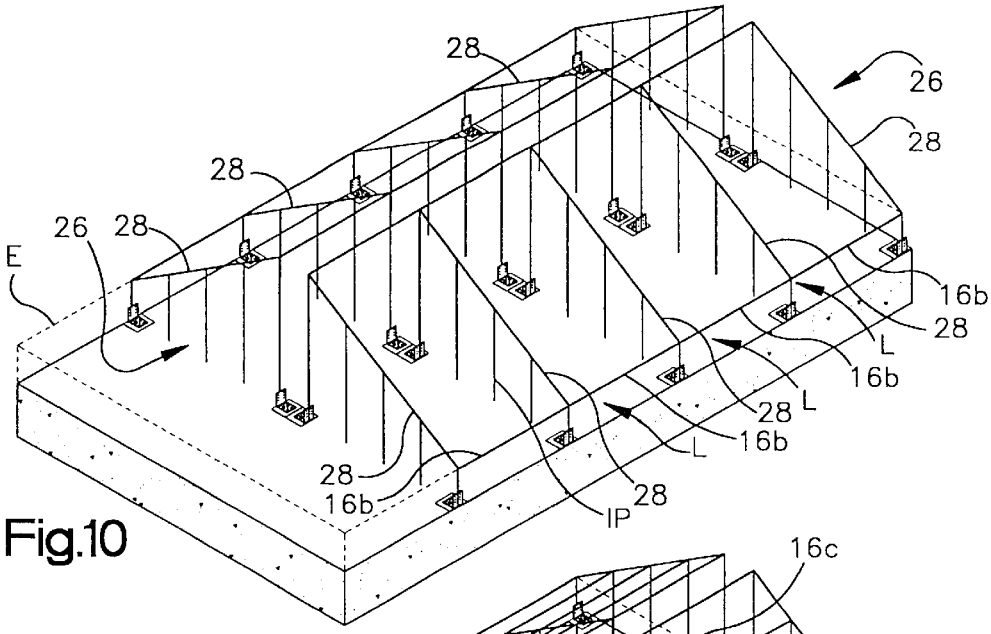
Figure 11:
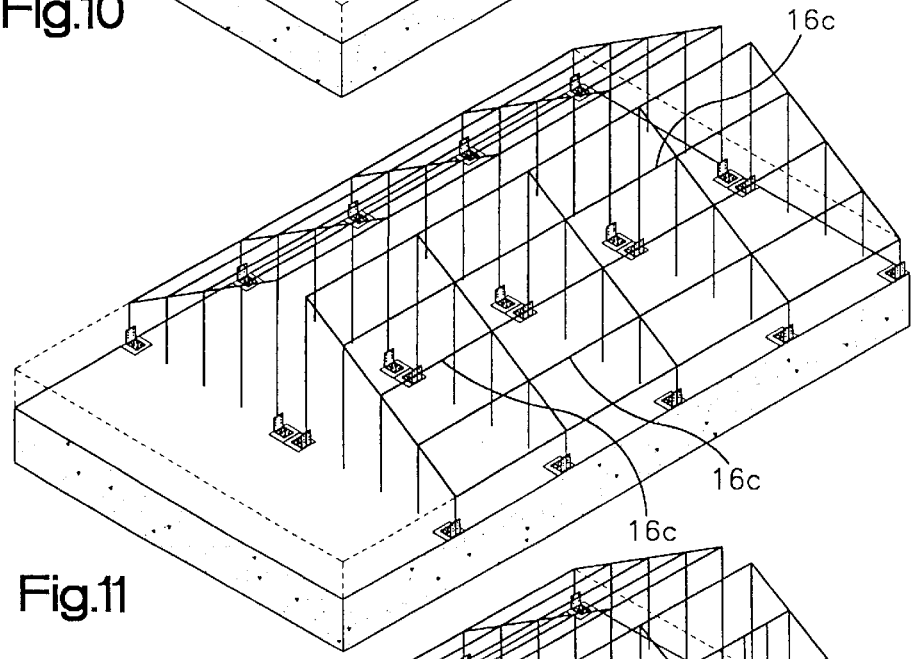

FIGS. 8–12 show, more specifically, the installation of a sloped build-up structural support construction on an existing roof top using the roofing clips C of the present invention (only one of which is labelled in FIG. 8). Installation of the roofing structure of the invention may be carried out over flat roofs, conventional sloped roofs, existing metal roofs, walls and for new roof construction. Paint or other marks (not shown) are made on the surface of the roof substrate to represent points of attachment of the posts on locations aligned with secondary support members such as steel joists, which underlie the roof substrate. A base member spreader plate 40 (only one of which is labelled) may be fastened to the support surface at each post mark and clips may be installed on the roof substrate at purlin lap locations L, as shown in FIGS. 8 and 10. Continuous elongated base members having a generally "Z" shape in cross section, may be used at the lower location instead of the clips. Shims may be disposed beneath the base members at the attachment locations, to prevent "damming" if it rains during installation.

As shown in FIG. 9, vertical dimensions are determined from established benchmarks to the low eave as well as to the high point of the roof, which represent imaginary finished limits or work points of the roof system, taken from the support surface or existing rooftop. Once the vertical height of the new roof system has been determined, erection begins at the highest and lowest vertical points while working with the maximum length of the bracing angle, for example, 20 feet. String lines assist in maintaining a constant slope of the bracing angle. The transverse frames are constructed, each being located at the longest feasible distance from each other. The bracing angles are set to an elevation of the intended bottom of the purlins. At the lower locations, the posts may be fastened to the clips C. String lines may be run longitudinally and enable intermediate framing to be lifted to the proper elevation. The transverse framing is erected and then the intermediate posts are fastened to the clips and extend up to the string lines.

Referring to FIG. 10, once the installation of the bracing angles 28 and the vertical posts between the high and low points is underway, bracing purlins 16B are installed to provide rigidity to the system. The bracing angles 28 act as templates for setting of the purlins. The bottom of the purlins should be at the same elevation as the top of the bracing angles.

Before setting the purlins, the clips are preferably installed to the posts at the upper locations. This will eliminate horizontal screwing of fasteners and can be accomplished by laying the purlin in position at the existing roof level and marking the post locations of the previously installed clips. The bracing angles may be installed at the purlin laps and the posts may be installed at intermediate locations on the purlin laps (e.g., at IP in FIG. 10).

Figure 12:
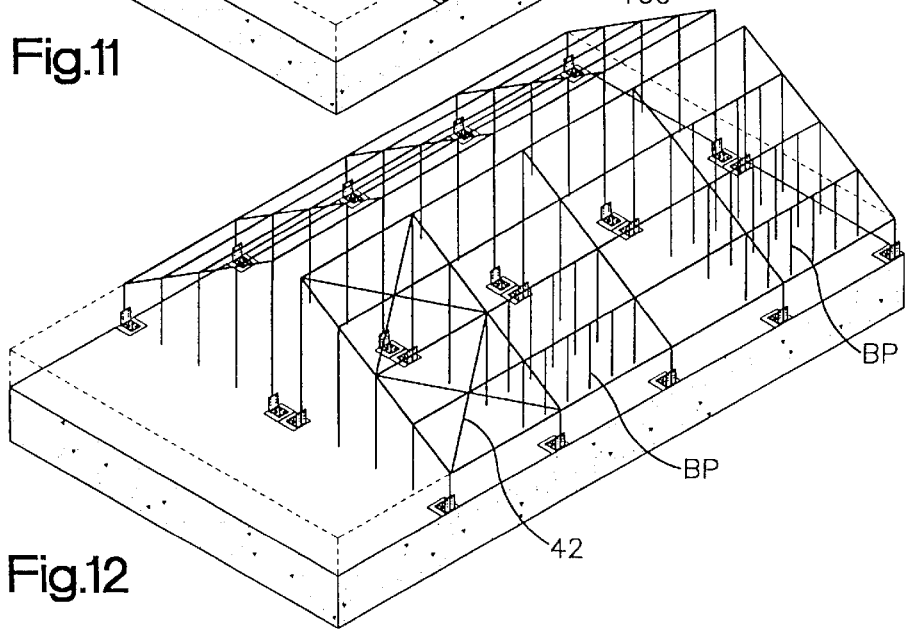

Referring to FIG. 11, intermediate purlins 16C are installed. Posts located between the purlin lap lines have not been installed yet. As shown in FIG. 12, the remaining posts between lap lines (BP) are installed, as well as any bracing 42. Normally, bracing is in the form of flat strapping located in the vertical plane at lap lines from eave to eave and at designated post runs longitudinally. The purlins are strapped in the horizontal plane to prevent rolling. Using longitudinal string lines at each purlin run and from eave to ridge at the mid-point between, enables the purlins to be leveled.

Although the invention has been described in its preferred form with a certain degree of particularity, it will be understood that the present disclosure of preferred embodiments has been made only by way of example and that various changes may be resorted to without departing from the true spirit and scope of the invention as hereafter claimed.

What is claimed is:

1. A method for fabricating a roofing structure comprising:

forming a first roofing bracket and a second roofing bracket each having a first leg extending at an angle from a second leg;

forming different sized holes in-said second leg of booth roofing brackets;

a plurality of patterned holes in said first leg of booth roofing brackets;

positioning said second leg of said first roofing bracket on a lower support surface on a roofing substrate;

positioning fasteners in select holes of said second leg of said first roofing bracket;

driving said fasteners into said lower support surface;

fastening said first leg of said first roof bracket to a lower end of a generally vertical support member;

positioning said first leg of said second roofing bracket against an upper end of said generally vertical support member;

positioning fasteners in select holes of said plurality of patterned holed in said first leg of said second roofing bracket such that said second leg of said second roofing bracket has a desired angular orientation angularly offset with respect to said vertical support member, said select holes being aligned adjacent a vertical center line of said vertical support member;

driving said fasteners into said vertical support member; and fastening said second leg of and second roofing bracket to a horizontal member.

2. The method of claim 1, said step of forming a plurality of patterned holes comprising forming a first row of holes and a second row of holes in parallel relation to each other, the holes of said first row of holes being aligned with and corresponding to respective holes of the holes of said second row of holes, said step of positioning fasteners in select holes of said plurality of patterned holes comprising:

placing one fastener in a hole of said first row of holes; and placing another fastener in a hole of said second row of holes, said hole of said second row of holes being offset from said hole of said first row of holes.

3. The method of claim 1, said step of forming a first roofing bracket and a second roofing, bracket comprising forming said first and second brackets of an identical configuration.

4. A method of fabricating a roofing structure comprising:

fabricating a plurality of posts and a plurality of elongated structural numbers and a plurality of brackets, each of said plurality of brackets having a first leg and a second leg extending at an angle to said first leg;

forming a plurality of patterned holes in said first leg of each bracket;

forming different sized holes in said second leg of each bracket;

fastening a lower end portion of said plurality of posts to a roof support surface such that an upper portion of said plurality of posts is vertically spaced from said lower end portion of said plurality of posts;

positioning said first leg of said plurality of brackets,on respective upper portions of said plurality of posts such that said second leg has a desired angular orientation with respect to a vertical plane;

placing fasteners into at least two select holes of said plurality of patterned holes in said first leg of each bracket which are generally aligned with a vertical center line of a respective post of said plurality of posts;

driving said fasteners through the two select holes into the respective post;

fastening said second leg of each bracket to a respective elongated structural member of said plurality of elongated structural members such that the elongated structural member extends horizontally, said plurality of elongated structural members defining a first roof slope; and fastening roof panels to said plurality of elongated structural member along said first roof slope.

5. The method of claim 4, said step of fastening a lower end portion comprising:

fastening said first leg of another plurality of brackets to said lower end portion of a respective post of said plurality of posts; and driving fasteners through respective select holes of said different sized holes of said second leg and into a roof substrate, said select holes of said different sized holes being spaced apart slots, said roof substrate being a bar joist having bar joist flanges, each of said fasteners respectively driven into a respective bar joist flange near a centerline of said bar joist flange.

6. The method of claim 5, said step of driving fasteners comprising driving different fasteners into different sizes of said respective select holes in said second leg.

7. The method of claim 4, each of said plurality of brackets having an identical configuration.

* * * * *